United States Patent [19]

Whitley

[11] Patent Number: 4,550,892

[45] Date of Patent: Nov. 5, 1985

[54] HOSE HOLDING DEVICE

[76] Inventor: Ray D. Whitley, 6021 Boulder Hwy., Las Vegas, Nev. 89122

[21] Appl. No.: 601,688

[22] Filed: Apr. 18, 1984

[51] Int. Cl.[4] ..... B05B 15/06

[52] U.S. Cl. ..... 248/90

[58] Field of Search ..... 248/75, 78, 70, 74.4, 248/60, 62, 68, 49, 89–93

[56] References Cited

U.S. PATENT DOCUMENTS

| | | | |
|---|---|---|---|
| 832,793 | 10/1906 | Jackson | 248/75 |
| 2,243,387 | 5/1941 | Livingston | 248/90 |
| 2,943,833 | 7/1960 | Ramse | 248/89 |
| 3,977,486 | 8/1976 | Kleinschmit | 248/68.1 |
| 3,991,960 | 11/1976 | Tanaka | 248/68.1 |

FOREIGN PATENT DOCUMENTS

| | | | |
|---|---|---|---|
| 793694 | 9/1968 | Canada | 248/75 |

*Primary Examiner*—Reinaldo P. Machado
*Assistant Examiner*—Alvin Chin-Shue

[57] ABSTRACT

This hose holding device serves to keep the water hose from falling, and dangling from a concrete truck when it is on the road. Primarily, it consists of a bracket having a second bracket secured within, for holding the hose and retaining its nozzle. It further includes a bar lever, which locks in place on the front open end of the device.

1 Claim, 2 Drawing Figures

HOSE HOLDING DEVICE

This invention relates to holding and support devices, and more particularly to a hose holding device.

The principal object of this invention is to provide a hose holding device, which will be unique in design for attachment to a concrete mixer truck at its rear, so as to hold and support properly the water hose that is used to add water to the loads, washout chutes, etc.

Another object of this invention is to provide a hose holding device, which will keep the water hose from being pulled from the truck when fully unwound.

Another object of this invention is to provide a hose holding device, which will be so designed, as to receive and retain coils of the hose within a specially formed bracket or frame, and the nozzle end of the hose will be received in a portion of the bracket, in a manner which will prevent it from coming free until it is desired to free it.

A further object of this invention is to provide a hose holding device, which will include a spring-loaded pivotal lever, which must be opened to release the coils or loops of the hose from the device, and the lever will include a handle thereon, for its operation by the vehicle's operator.

A still further object of this invention is to provide a hose holding device, which will prevent the hose from coming loose and dragging on the pavement, making it necessary for the operator of the vehicle to stop in heavy traffic, and the device also prevents the nozzle of the hose from striking passing or following vehicles in windshields and lights, which can possibly cause damage or an accident to occur.

An even further object of this invention is to provide a hose holding device, which will be further unique over the prior art, in that it will prevent the often replacing of very expensive high pressure hose and nozzle, which becomes unnecessarily damaged by dragging on pavement, and the device is easier and faster to use than those of the prior art. The design is even further such, that it can be manipulated with bare or gloved hands, whether the operator is right or left handed.

Other objects are to provide a hose holding device, which is simple in design, inexpensive to manufacture, rugged in construction, easy to use, and efficient in operation.

Figure 1:
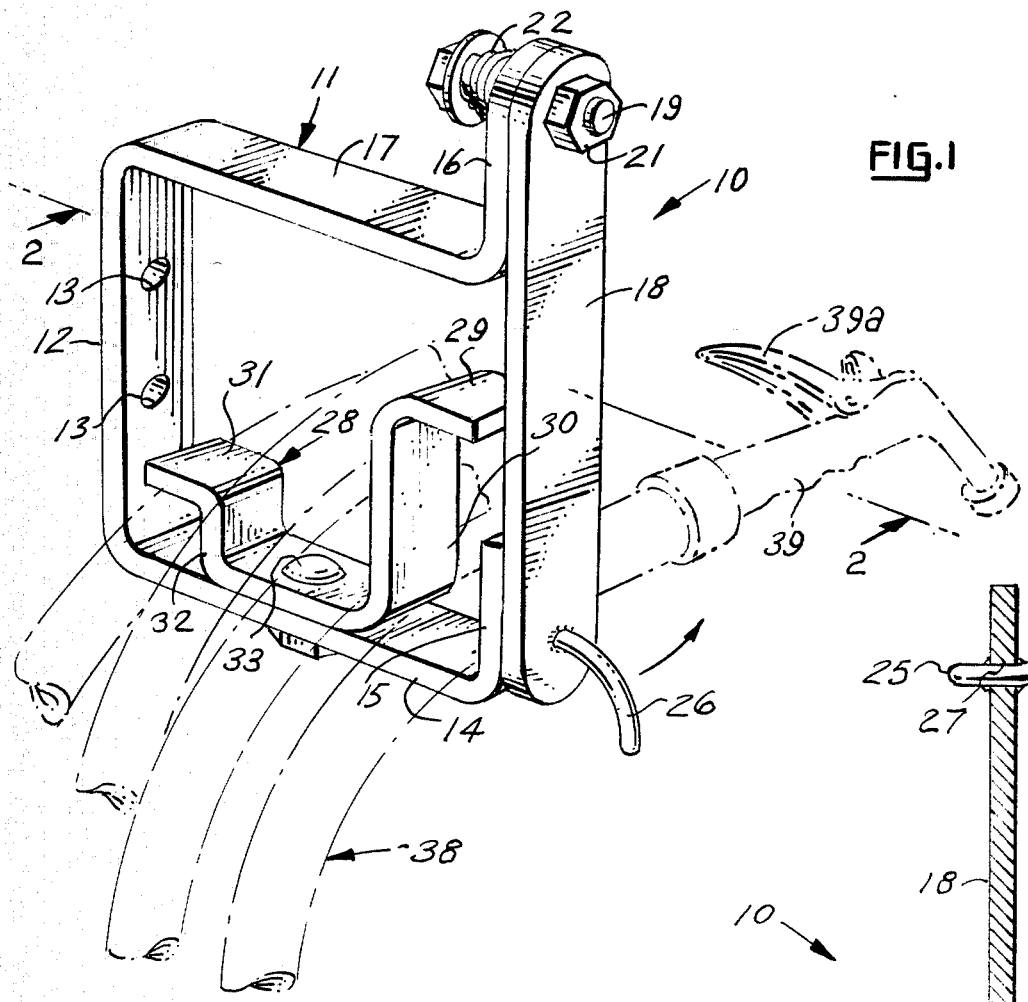
Figure 2:
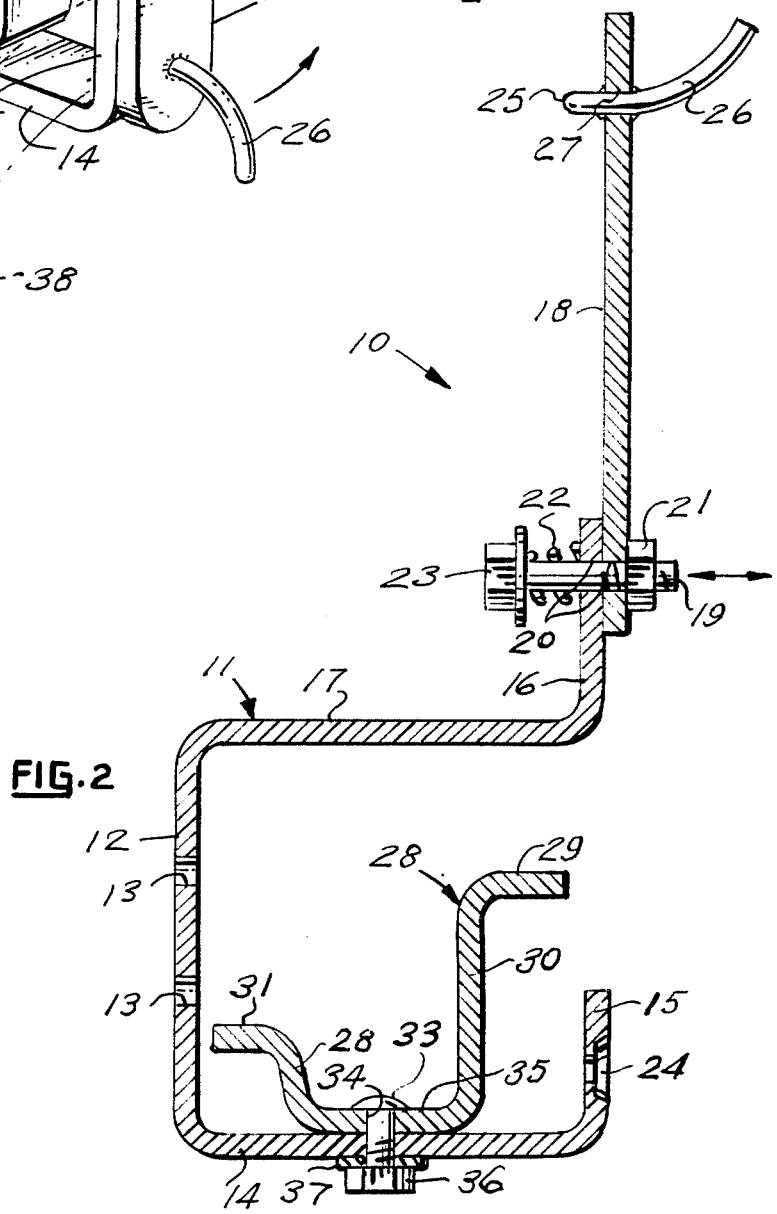

These, and other objects, will be readily evident, upon a study of the following specification, and the accompanying drawing, wherein:

FIG. 1 is a perspective view of the present invention, shown in closed condition with a hose therein, which is illustrated fragmentary and in phantom lines, and FIG. 2 is a cross-sectional view, taken along the line 2—2 of FIG. 1, which illustrates the invention in open condition, with the hose removed therefrom.

Accordingly, a device 10 is shown to include a bracket 11, which is fabricated of a suitable flat metal. Bracket 11 is substantially box-shaped in configuration, which includes a rear portion 12, having a pair of spaced openings 13 therethrough, for receiving suitable fasteners, to mount device 10 to the rear of a concrete mixer truck (not shown). The lower portion 14 includes an upward vertically extending lip 15, formed thereof, for a purpose, which hereinafter will be described. A second upwardly extending lip 16 is formed at the end of the upper portion 17 of bracket 11, and aligns with lip 15 of lower portion 14, for engagement with a bar lever

18, which is pivotally received on bolt fastener 19, which is received in openings 20 of lip 16 and the upper end of bar lever 18. Bolt fastener 19 receives a lock nut fastener 21, which secures bar lever 18 to lip 16, and a coil spring 22 is received on bolt fastener 19, and urges, at one end against lip 16, and urges at its opposite end against the flanged head 23 of bolt fastener 19, thus keeping bar lever 18 under constant spring pressure, for holding in the upright raised condition, or in the down and closed condition. A counter-sunk opening 24, through lip 15, removably receives the projecting end 25 of arcuately curved handle 26, which extends downward, and is welded within opening 27 of the lower portion of bar lever 18. Handle 26 is curved, so as to be pulled outward, to remove the rounded end 25 from locking engagement within opening 24 of lip 15, and, when in locking engagement in opening 24, the force of spring 22 on fastener 19 serves to prevent end 25 of 26 from becoming dislodged when the vehicle is in motion.

A second bracket 28 is provided, and is fabricated of the same width of material as bracket 11, and is of "U"-shaped configuration, having an outwardly extending lip 29 formed on the upper end of its long leg portion 30. A similarly disposed lip 31 is formed on the upper end of the shorter leg portion 32, and lips 29 and 31 serve a purpose which will hereinafter be described. A bolt fastener 33 is received in openings 34 of the lower portion 35 of bracket 28, and the lower portion 14 of bracket 11, and a nut fastener 36 and lock washer 37, are received on bolt fastener 33, which locks bracket 28 securely to lower portion 14. The rear end of hose 38 is received in bracket 11 beneath lip 31 of bracket 28, and is attached to the truck, thus preventing hose 38 from being pulled from the truck, when 38 is fully unwound. The remaining coils of hose 38 are received within the confines of bracket 11, above second bracket 28, and the nozzle 39 of 38 is prevented from coming out of bracket 11, by the lip 29 of second bracket 28.

In use, bar lever 18 is pulled outward by handle 26, which is then pivoted upward, thus pivoting lever 18 on bolt fastener 19, and when released, lever 18 remains in the upward condition by the spring 22 pressure. The hose 38 is then coiled, and entered into the open front end of bracket 11, and is rested on top of the second bracket 28. The front end portion of hose 38 is then placed within the confines between lips 15 and 29, with the nozzle 39 extending forwards toward the front of the vehicle, and the size of the nozzle and its control lever **39*a* serve to retain nozzle 39, by the lower portion 14 and the lip 29 serving as a stop against nozzle 39, to prevent it from falling out of device 10**.

While various changes may be made in the detail construction, it is understood that such changes will be within the spirit and scope of the present invention, as is defined by the appended claims.

What I now claim is:

1. A hose holding device, comprising, in combination, a first bracket, a second bracket and a bar lever; said first bracket comprising a generally "C"-shaped, flat bar having a vertical leg between parallel horizontal arms, opposite ends of said bar being upwardly bent and forming parallel, aligned, vertical lips, said second bracket comprising a generally "J"-shaped, flat bar, opposite ends of said "J"-shaped bar being bent in outwardly opposite directions and forming horizontal lips, said second bracket being located inside said first bracket, a single bolt fastener securing a lower portion of said second bracket to a lower portion of said first bracket, both said brackets being in the same flat plain, a space between an upper side of said second bracket and an upper of said arms of said first bracket for receiving a plurality of turns of a hose coiled therethrough, a space between a lower of said second bracket lips and a lower of said first bracket arms for receiving a coupling end of said hose, a space between an upper of said second bracket lips and said first bracket lower arms for receiving a nozzle end of said hose, said bar lever bridging across an entry to said hose coil turn space and an entry to said hose nozzle end space, a bolt fastener through said first bracket upper arm lip pivotally supporting one end of said bar lever, an opening through said first bracket lower arm lip for receiving a projection on an opposite end of said bar lever, spring means to disengage said projection from said lip, and mounting means on said first bracket for attachment to a rear of a concrete mixer truck.

* * * * *